US007267453B2

(12) United States Patent
Chang et al.

(10) Patent No.: US 7,267,453 B2
(45) Date of Patent: Sep. 11, 2007

(54) MULTIFUNCTIONAL STICK ASSEMBLY

(76) Inventors: Hung-Shen Chang, 22, Xin Yi St., Taoyuan (TW); Ching-Hwan Lin, 95, Lane 30, Yong Ji Rd., Taipei (TW)

( * ) Notice: Subject to any disclaimer, the term of this patent is extended or adjusted under 35 U.S.C. 154(b) by 117 days.

(21) Appl. No.: 11/100,824

(22) Filed: Apr. 7, 2005

(65) Prior Publication Data

US 2006/0227534 A1 Oct. 12, 2006

(51) Int. Cl.
*B25B 23/18* (2006.01)

(52) U.S. Cl. ..... 362/120; 362/102; 361/232

(58) Field of Classification Search ..... 362/102, 362/577

See application file for complete search history.

(56) References Cited

U.S. PATENT DOCUMENTS

| | | | | |
|---|---|---|---|---|
| 4,842,277 | A * | 6/1989 | LaCroix | 463/47.3 |
| 5,036,442 | A * | 7/1991 | Brown | 362/102 |
| 5,079,679 | A * | 1/1992 | Chin-Fa | 362/102 |
| 5,081,568 | A * | 1/1992 | Dong et al. | 362/184 |
| 5,622,423 | A * | 4/1997 | Lee | 362/186 |
| 6,213,623 | B1 * | 4/2001 | Campman | 362/202 |
| 6,249,998 | B1 * | 6/2001 | NakaMats | 40/452 |
| 6,293,684 | B1 * | 9/2001 | Riblett | 362/184 |
| 6,371,625 | B2 * | 4/2002 | Campman | 362/184 |
| 6,637,924 | B2 * | 10/2003 | Pelka et al. | 362/555 |
| 6,791,816 | B2 * | 9/2004 | Stethem | 361/232 |
| 2005/0046582 | A1 * | 3/2005 | Kessel et al. | 340/815.45 |
| 2006/0082988 | A1 * | 4/2006 | Riblett et al. | 362/120 |

* cited by examiner

*Primary Examiner*—Ali Alavi
*Assistant Examiner*—Hargobind S. Sawhney
(74) *Attorney, Agent, or Firm*—Alan Kamrath; Kamrath & Associates PA

(57) ABSTRACT

A stick assembly for a traffic use includes a handle having an inside formed with a receiving space, a battery unit mounted in the receiving space of the handle, at least one circuit controller mounted in the receiving space of the handle, at least one tube mounted on a first end of the handle, and a plurality of light-emitting members mounted in the tube and connected to the circuit controller. Thus, the multifunctional stick assembly functions as a baton, a flashlight and a stun gun and can be used to supply an auxiliary electric power.

17 Claims, 5 Drawing Sheets

MULTIFUNCTIONAL STICK ASSEMBLY

BACKGROUND OF THE INVENTION

1. Field of the Invention

The present invention relates to a stick assembly, and more particularly to a multifunctional stick assembly for a traffic use.

2. Description of the Related Art

A stick for a traffic use has a light reflective effect and has a guide function so as to facilitate the traffic policeman conducting the traffic. A conventional stick in accordance with the prior art was disclosed in the Taiwanese Patent Publication No. 336757 and has a warning function. Another conventional stick in accordance with the prior art was disclosed in the Taiwanese Patent Publication No. 407779 and has a light emitting function. Another conventional stick in accordance with the prior art was disclosed in the Taiwanese Patent Publication No. 579033 and has a light emitting and warning function. Another conventional stick in accordance with the prior art was disclosed in the Taiwanese Patent Publication No. M246766 and has a light emitting function. Another conventional stick in accordance with the prior art was disclosed in the Taiwanese Patent Publication No. 585331 and employs the solar energy as its power source.

SUMMARY OF THE INVENTION

In accordance with the present invention, there is provided a stick assembly, comprising a handle having an inside formed with a receiving space, a battery unit mounted in the receiving space of the handle, at least one circuit controller mounted in the receiving space of the handle, at least one tube mounted on a first end of the handle, and a plurality of light-emitting members mounted in the tube and connected to the circuit controller.

The primary objective of the present invention is to provide a multifunctional stick assembly for a traffic use.

Another objective of the present invention is to provide a stick assembly, wherein the tube is made of a hard material that can endure a high impact so that the stick assembly functions as a baton.

A further objective of the present invention is to provide a stick assembly, wherein the light-emitting members emit a light outward from the tube so that the stick assembly functions as a traffic baton to facilitate the traffic policeman conducting the traffic.

A further objective of the present invention is to provide a stick assembly, wherein the light-emitting members have different colors to enhance the outer appearance of the tube, thereby enhancing the aesthetic quality of the stick assembly.

A further objective of the present invention is to provide a stick assembly, wherein the stick assembly has an illuminating device so that the stick assembly functions as a flashlight to provide an illuminating effect.

A further objective of the present invention is to provide a stick assembly, wherein the stick assembly has a guard device so that the stick assembly functions as a stun gun to provide a body guard or isolation function.

A further objective of the present invention is to provide a stick assembly, wherein the stick assembly has a plurality of optical energy boards to supply an auxiliary electric power.

Further benefits and advantages of the present invention will become apparent after a careful reading of the detailed description with appropriate reference to the accompanying drawings.

DETAILED DESCRIPTION OF THE INVENTION

Figure 1:
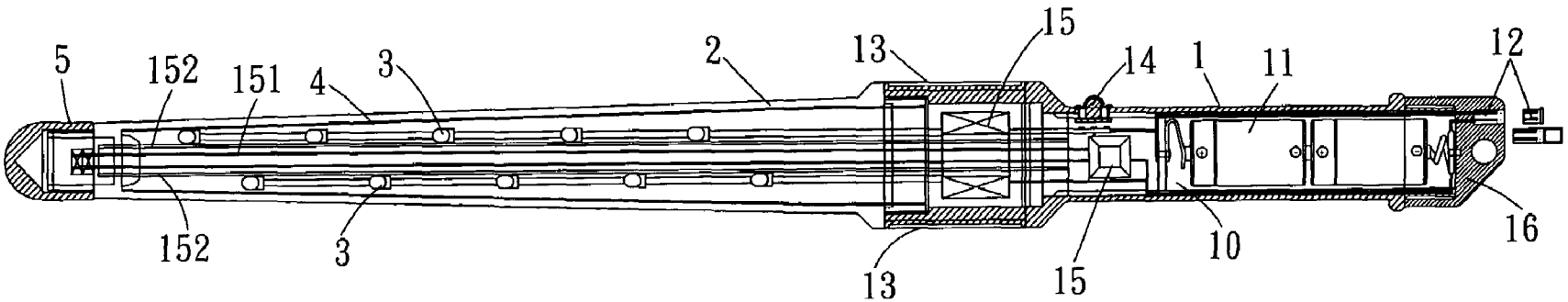
FIG. 1 is a plan cross-sectional assembly view of a stick assembly in accordance with the preferred embodiment of the present invention.
Figure 2:
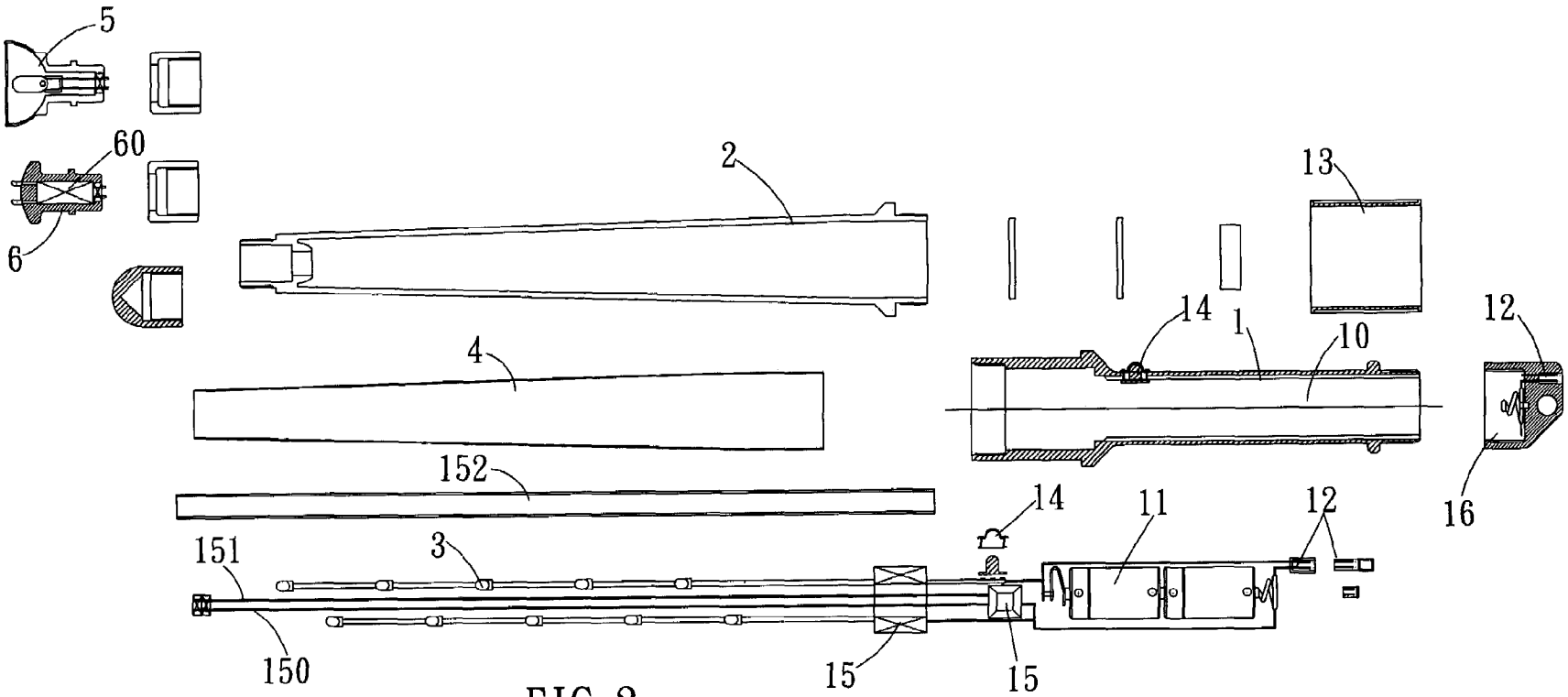
FIG. 2 is a plan exploded cross-sectional view of the stick assembly as shown in FIG. 1.

Referring to the drawings and initially to FIGS. 1 and 2, a stick assembly in accordance with the preferred embodiment of the present invention comprises a handle 1 having an inside formed with a receiving space 10, a battery unit 11 mounted in the receiving space 10 of the handle 1, a circuit controller 15 mounted in the receiving space 10 of the handle 1, an optical energy collector 13 mounted on an outside of the handle 1 and connected to the circuit controller 15 to supply an electric power, a control switch 14 mounted on the outside of the handle 1 and connected to the circuit controller 15 to control an operation, a tube 2 mounted on a first end of the handle 1, a plurality of light-emitting members 3 mounted in the tube 2 and connected to the circuit controller 15, an optical reflective board 4 mounted in the tube 2 and connected to the circuit controller 15, and an end cap 16 removably mounted on a second end of the handle 1.

The tube 2 is a light permeable tube. Preferably, the tube 2 is made of a hard material that can endure a high impact so that the tube 2 functions as a baton. The tube 2 has a first end mounted on the first end of the handle 1.

Each of the light-emitting members 3 is a light-emitting diode (LED) for emitting a light which is reflected by the optical reflective board 4 and is emitted outward from the tube 2 to facilitate the traffic policeman conducting the traffic. The light-emitting members 3 have different colors to enhance the outer appearance of the tube 2.

The battery unit 11 is a common battery unit, a charageable battery unit that is charged by an external power, such as a charging device 12 mounted on the end cap 16, or a storage battery unit that can storage an electric power from the optical energy collector 13.

The stick assembly further comprises an illuminating device 5 or a guard device 6 selectively mounted on a second end of the tube 2. The illuminating device 5 or the guard device 6 is connected to the circuit controller 15 by a power line 150 and a control line 151. The power line 150 and the control line 151 are mounted in a protective jacket 152 mounted in the tube 2. The illuminating device 5 functions as a flashlight to provide an illuminating effect. The guard device 6 has a power amplification circuit 60 to form an electric shock head so that the guard device 6 functions as a stun gun to provide a guard or isolation function.

Figure 3:
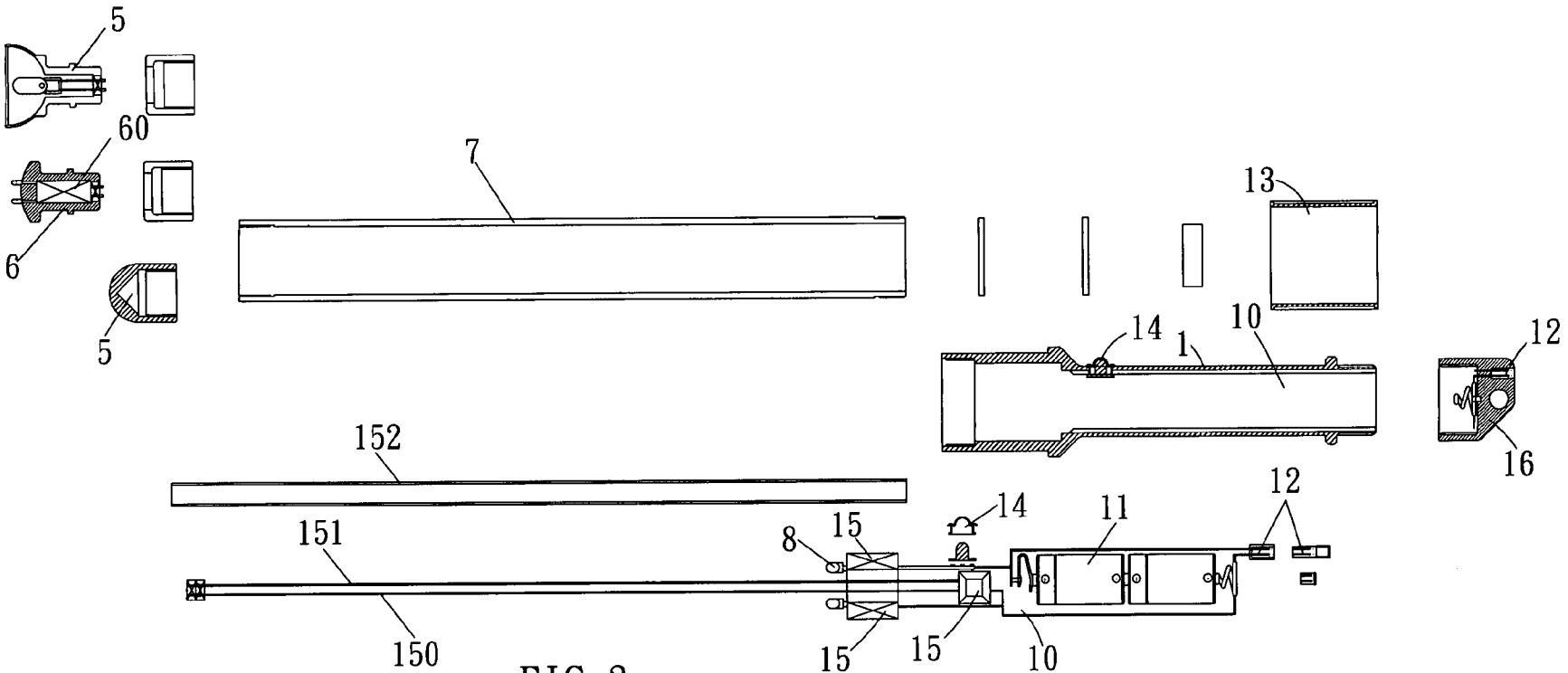
FIG. 3 is a plan exploded cross-sectional view of a stick assembly in accordance with another preferred embodiment of the present invention.
Figure 4A:
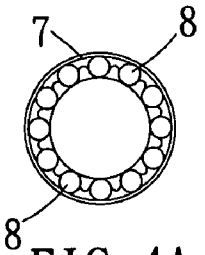
FIG. 4A is a side plan view of the tube of the stick assembly as shown in FIG. 4.
Figure 4:
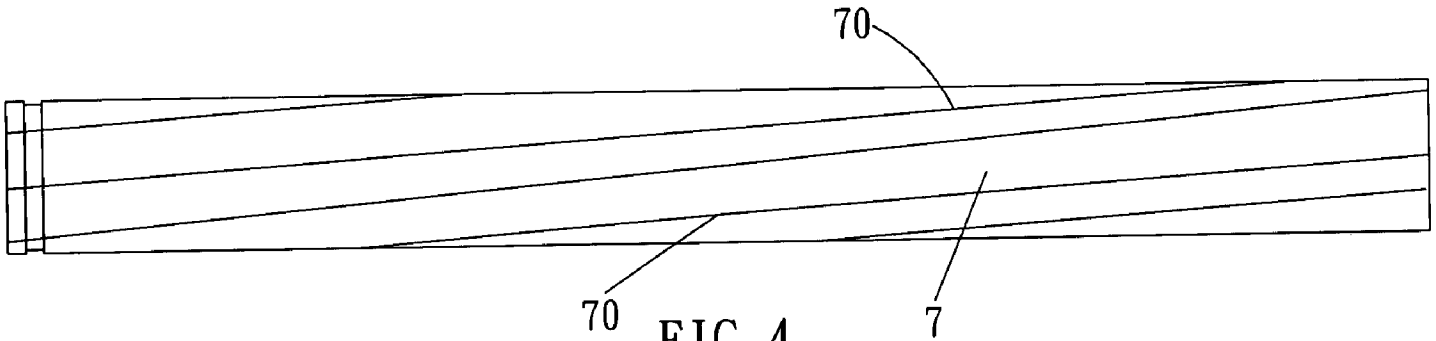
FIG. 4 is a plan view of a tube of the stick assembly as shown in FIG. 3.
Figure 5:
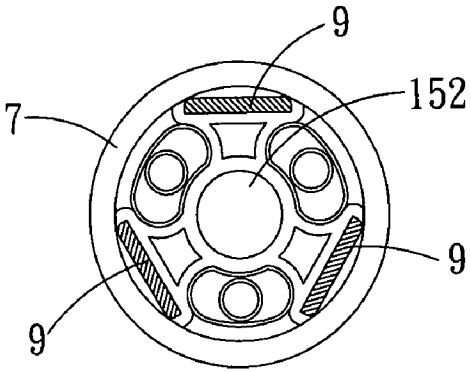
FIG. 5 is a side plan cross-sectional view of the tube of the stick assembly as shown in FIG. 4.

Referring to FIGS. 3-5, in accordance with another preferred embodiment of the present invention, the tube 7 is a light gathering tube made of light gathering material, such as PC, acrylic, glass or the like. The tube 7 has a plurality of light reflective flow channels 70 having determined angles. The light-emitting members 8 are located at a bottom edge of the tube 7 and have different colors. Each of the light-emitting members 8 is a light-emitting diode (LED) for emitting a light which is reflected and amplified by the light reflective flow channels 70 of the tube 7 and is emitted outward from the tube 7 to facilitate the traffic policeman conducting the traffic. The light-emitting members 8 are arranged in an annular manner as shown in FIG. 4A and have different colors to enhance the outer appearance of the tube 7. The stick assembly further comprises a plurality of optical energy boards 9 (see FIG. 5) mounted in the tube 7 and connected to the circuit controller 15 to supply an auxiliary electric power.

Figure 6:
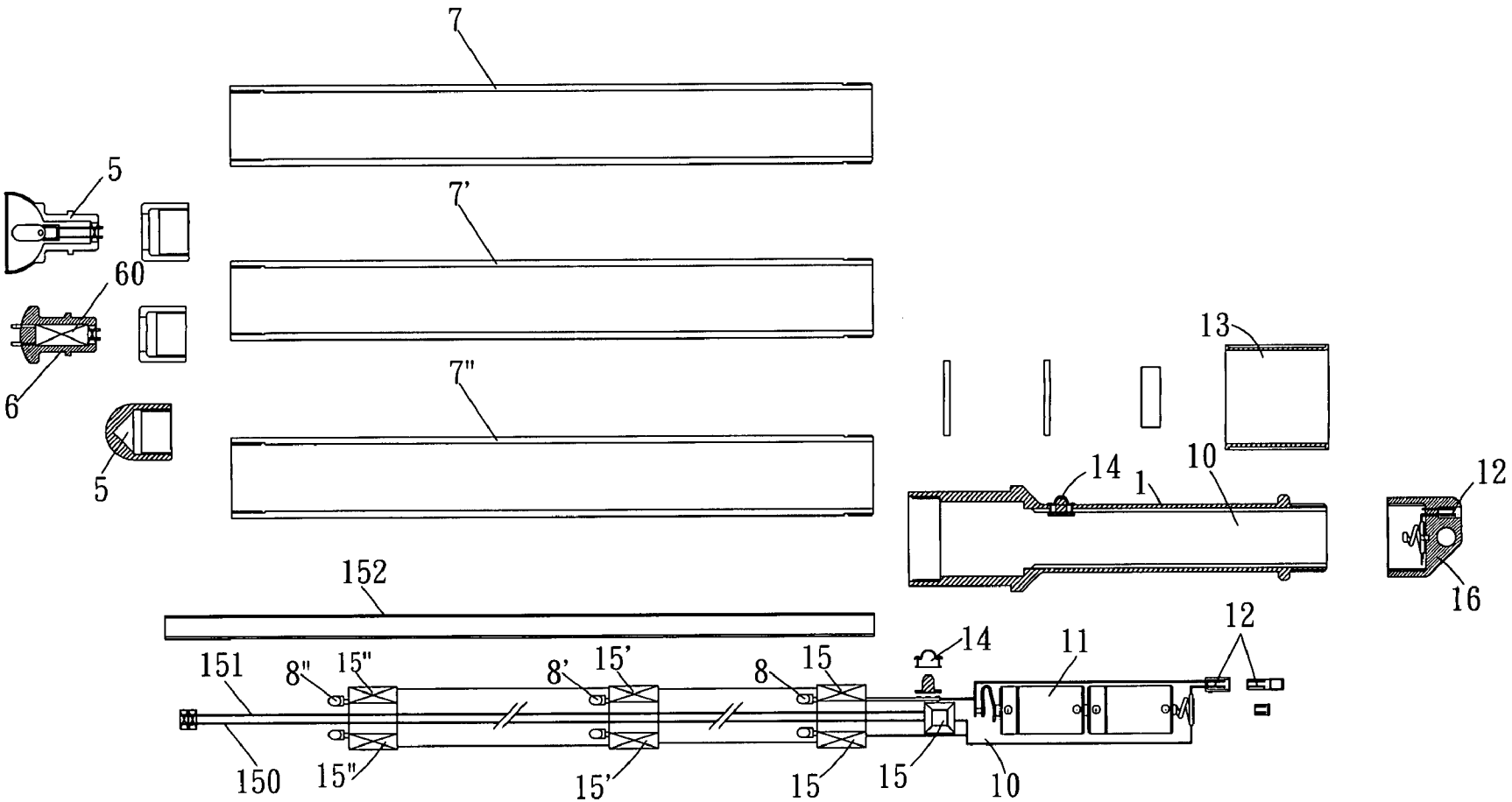
FIG. 6 is a plan exploded cross-sectional view of a stick assembly in accordance with another preferred embodiment of the present invention.

Referring to FIG. 6, the stick assembly in accordance with another preferred embodiment of the present invention comprises a plurality of (preferably three) tubes 7, 7' and 7" for mounting a plurality of light-emitting members 8, 8' and 8" respectively to emit light rays having different colors. Each of the light-emitting members 8, 8' and 8" is connected to and controlled by a corresponding circuit controller 15, 15' and 15" respectively.

Accordingly, the tube is made of a hard material that can endure a high impact so that the stick assembly functions as a baton. In addition, the light-emitting members emit a light outward from the tube so that the stick assembly functions as a traffic baton so as to facilitate the traffic policeman conducting the traffic. Further, the light-emitting members have different colors to enhance the outer appearance of the tube, thereby enhancing the aesthetic quality of the stick assembly. Further, the stick assembly has an illuminating device so that the stick assembly functions as a flashlight to provide an illuminating effect. Further, the stick assembly has a guard device so that the stick assembly functions as a stun gun to provide a body guard or isolation function. Further, the stick assembly has a plurality of optical energy boards to supply an auxiliary electric power.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A stick assembly, comprising:

a handle having an inside formed with a receiving space;

a battery unit mounted in the receiving space of the handle;

at least one circuit controller mounted in the receiving space of the handle;

at least one tube having a first end mounted on a first end of the handle;

a plurality of light-emitting members mounted in the tube and connected to the circuit controller;

a guard device selectively mounted on a second end of the tube;

wherein the guard device is connected to the circuit controller by a power line and a control line;

the power line and the control line are mounted in a protective jacket mounted in the tube;

the guard device has a power amplification circuit to form an electric shock head so that the guard device functions as a stun gun.

2. The stick assembly in accordance with claim 1, wherein the tube is a light permeable tube.

3. The stick assembly in accordance with claim 1, wherein the tube is made of a hard material that can endure a high impact so that the tube functions as a baton.

4. The stick assembly in accordance with claim 1, wherein each of the light-emitting members is a light-emitting diode (LED).

5. The stick assembly in accordance with claim 1, further comprising an optical energy collector mounted on an outside of the handle and connected to the circuit controller to supply an electric power.

6. The stick assembly in accordance with claim 5, wherein the battery unit is a storage battery unit that can storage an electric power from the optical energy collector.

7. The stick assembly in accordance with claim 1, further comprising a control switch mounted on an outside of the handle and connected to the circuit controller to control an operation.

8. The stick assembly in accordance with claim 1, further comprising an optical reflective board mounted in the tube and connected to the circuit controller.

9. The stick assembly in accordance with claim 8, wherein each of the light-emitting members emits a light which is reflected by the optical reflective board and is emitted outward from the tube.

10. The stick assembly in accordance with claim 1, wherein the light-emitting members have different colors.

11. The stick assembly in accordance with claim 1, further comprising an end cap removably mounted on a second end of the handle.

12. The stick assembly in accordance with claim 11, wherein the battery unit is a changeable battery unit that is charged by a charging device mounted on the end cap.

13. The stick assembly in accordance with claim 1, further comprising an illuminating device selectively mounted on the second end of the tube, wherein the illuminating device is connected to the circuit controller by the power line and the control line.

14. The stick assembly in accordance with claim 1, wherein the tube is a light gathering tube made of light gathering material.

15. The stick assembly in accordance with claim 1, wherein the tube has a plurality of light reflective flow channels having determined angles.

16. The stick assembly in accordance with claim 1, further comprising a plurality of optical energy boards mounted in the tube and connected to the circuit controller to supply an auxiliary electric power.

17. The stick assembly in accordance with claim 1, wherein the light-emitting members are located at a bottom edge of the tube and are arranged in an annular manner.

* * * * *